US011582855B2

(12) United States Patent
Sordi et al.

(10) Patent No.: US 11,582,855 B2
(45) Date of Patent: Feb. 14, 2023

(54) X-RAY EMITTING UNIT WITH A PLURALITY OF OPENINGS FOR X-RAYS AND FOR COOLING AND ELECTRICALLY INSULATING LIQUID AND RADIOLOGICAL APPARATUSES

(71) Applicant: GENERAL MEDICAL MERATE S.P.A., Seriate (IT)

(72) Inventors: Fabio Sordi, Arese (IT); Fabio Veronelli, Vercurago (IT)

(73) Assignee: GENERAL MEDICAL MERATE S.P.A., Seriate (IT)

( * ) Notice: Subject to any disclaimer, the term of this patent is extended or adjusted under 35 U.S.C. 154(b) by 67 days.

(21) Appl. No.: 17/053,616

(22) PCT Filed: May 10, 2019

(86) PCT No.: PCT/IB2019/053856

§ 371 (c)(1),
(2) Date: Nov. 6, 2020

(87) PCT Pub. No.: WO2019/215683

PCT Pub. Date: Nov. 14, 2019

(65) Prior Publication Data

US 2021/0267041 A1 Aug. 26, 2021

(30) Foreign Application Priority Data

May 11, 2018 (IT) ..... 102018000005279

(51) Int. Cl.
*H05G 1/02* (2006.01)
*H05G 1/04* (2006.01)

(52) U.S. Cl.
CPC ..... *H05G 1/025* (2013.01); *H05G 1/04* (2013.01); *H01J 2235/12* (2013.01)

(58) Field of Classification Search
CPC ..... H05G 1/025; H05G 1/04; H01J 2235/12
See application file for complete search history.

(56) References Cited

U.S. PATENT DOCUMENTS

2008/0317210 A1 12/2008 Lu et al.
2013/0114794 A1* 5/2013 Yamamoto ..... H05G 1/06 378/140

(Continued)

FOREIGN PATENT DOCUMENTS

DE 886638 C * 8/1953
DE 886638 C 8/1953

(Continued)

*Primary Examiner* — Chih-Cheng Kao
(74) *Attorney, Agent, or Firm* — Dickinson Wright PLLC; Nicholas P. Coleman

(57) ABSTRACT

The X-ray emitting unit (100) comprises a box-shaped container (110) with a chamber inside it, and an X-ray tube located in the chamber; the box-shaped container (110) is provided with an opening (111) for X-rays and a plurality of openings for cooling and electrically insulating liquid; having: a first main opening (112A) for the inlet of cooling and electrically insulating liquid, a second main opening for the outlet of cooling and electrically insulating liquid; furthermore, the box-shaped container (110) has: at least one secondary opening (114A) of the first type for cooling and electrically insulating liquid and/or at least one secondary opening (116A, 116B) of the second type for cooling and electrically insulating liquid.

13 Claims, 3 Drawing Sheets

(56) References Cited

U.S. PATENT DOCUMENTS

| | | | | |
|---|---|---|---|---|
| 2014/0056412 | A1* | 2/2014 | Chen | H01J 35/153 378/147 |
| 2014/0211923 | A1* | 7/2014 | Chen | H05G 1/02 378/147 |

FOREIGN PATENT DOCUMENTS

| | | | | |
|---|---|---|---|---|
| JP | 2001015294 | A | 1/2001 | |
| WO | 2013042812 | A1 | 3/2013 | |
| WO | WO-2013042812 | A1 * | 3/2013 | H05G 1/06 |

* cited by examiner

X-RAY EMITTING UNIT WITH A PLURALITY OF OPENINGS FOR X-RAYS AND FOR COOLING AND ELECTRICALLY INSULATING LIQUID AND RADIOLOGICAL APPARATUSES

FIELD OF THE INVENTION

The present invention relates to an X-ray emitting unit with a plurality of openings which are used for X-rays and for cooling and electrically insulating liquid (naturally, each of these openings is designed for the passage of X-rays only or of liquid only), and radiological apparatuses that use it.

BACKGROUND

X-ray emitting units have been known for some time.

These units are used, for example, in radiological apparatuses for industrial applications and in radiological apparatuses for medical applications.

It is important that the X-ray tube, which is part of the group, is effectively and uniformly cooled so that it can work well and for a long time.

Furthermore, it is important for the unit only to irradiate X-rays from the relevant opening thereof.

SUMMARY

The general aim of the present invention is to improve the prior art, in particular to provide a unit that allows excellent cooling of the X-ray tube.

The specific aim of the present invention is to allow excellent cooling of the X-ray tube and, at the same time, prevent undesired radiation.

These and other aims are substantially reached thanks to what is expressed in the appended claims that form an integral part of the present description.

The idea underpinning the present invention is to provide a plurality of openings for the inlet and outlet of the cooling and electrically insulating liquid into and from the container of the unit.

Advantageously, these openings are provided with means that allow the flow of cooling and electrically insulating liquid through the openings, but prevent radiation through the openings.

LIST OF FIGURES

Figure 1:
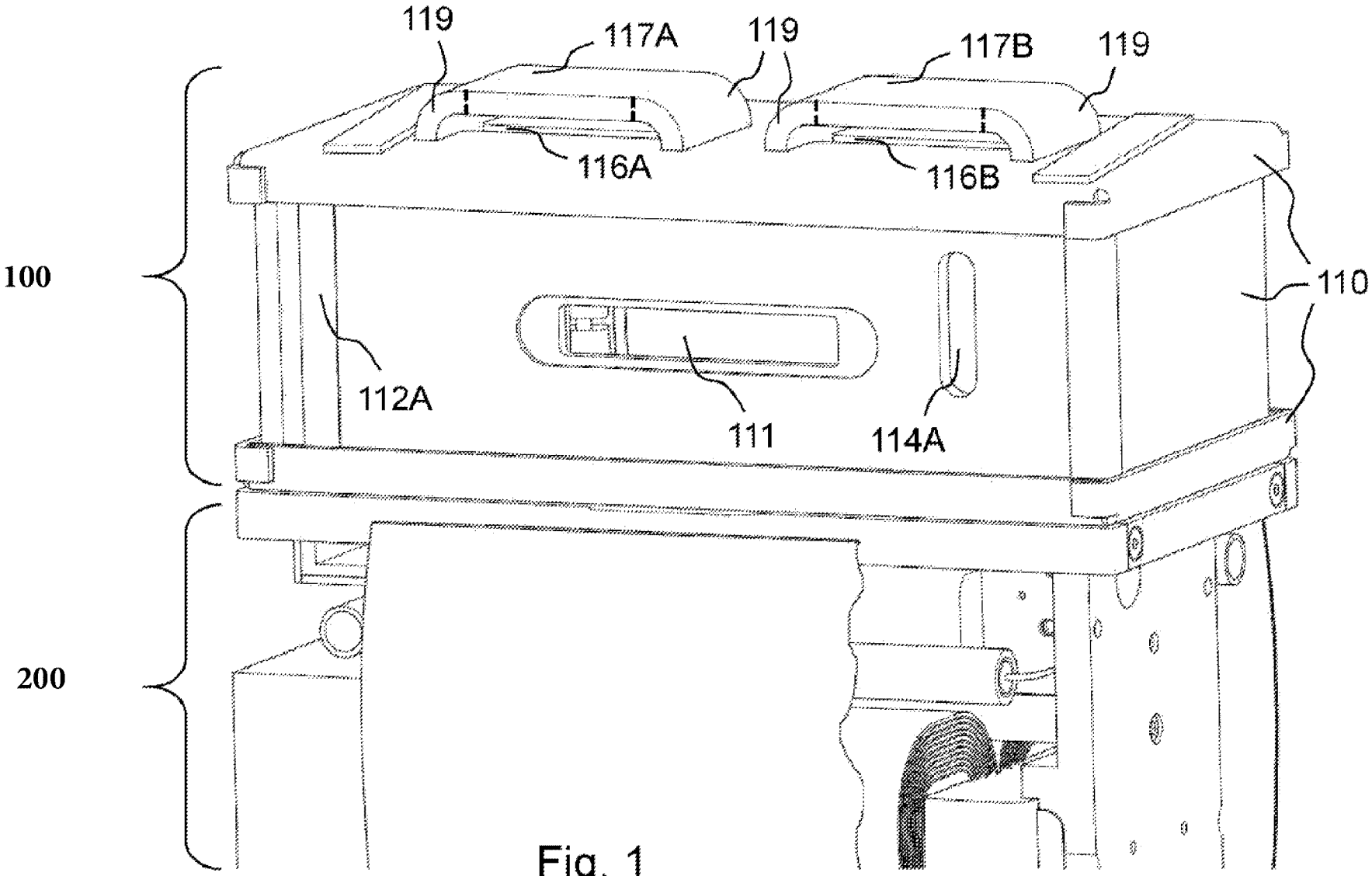
Figure 2:
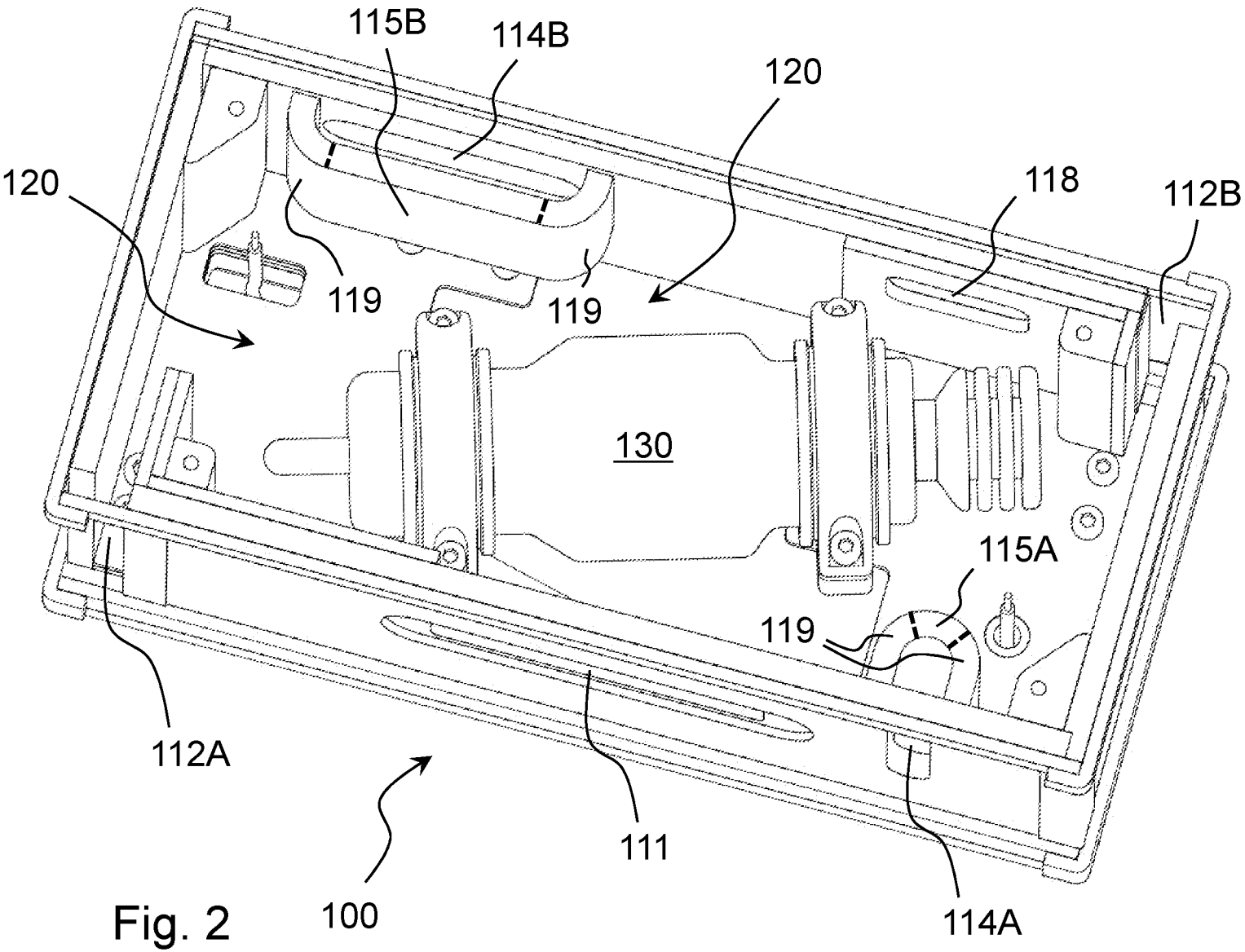
Figure 3:
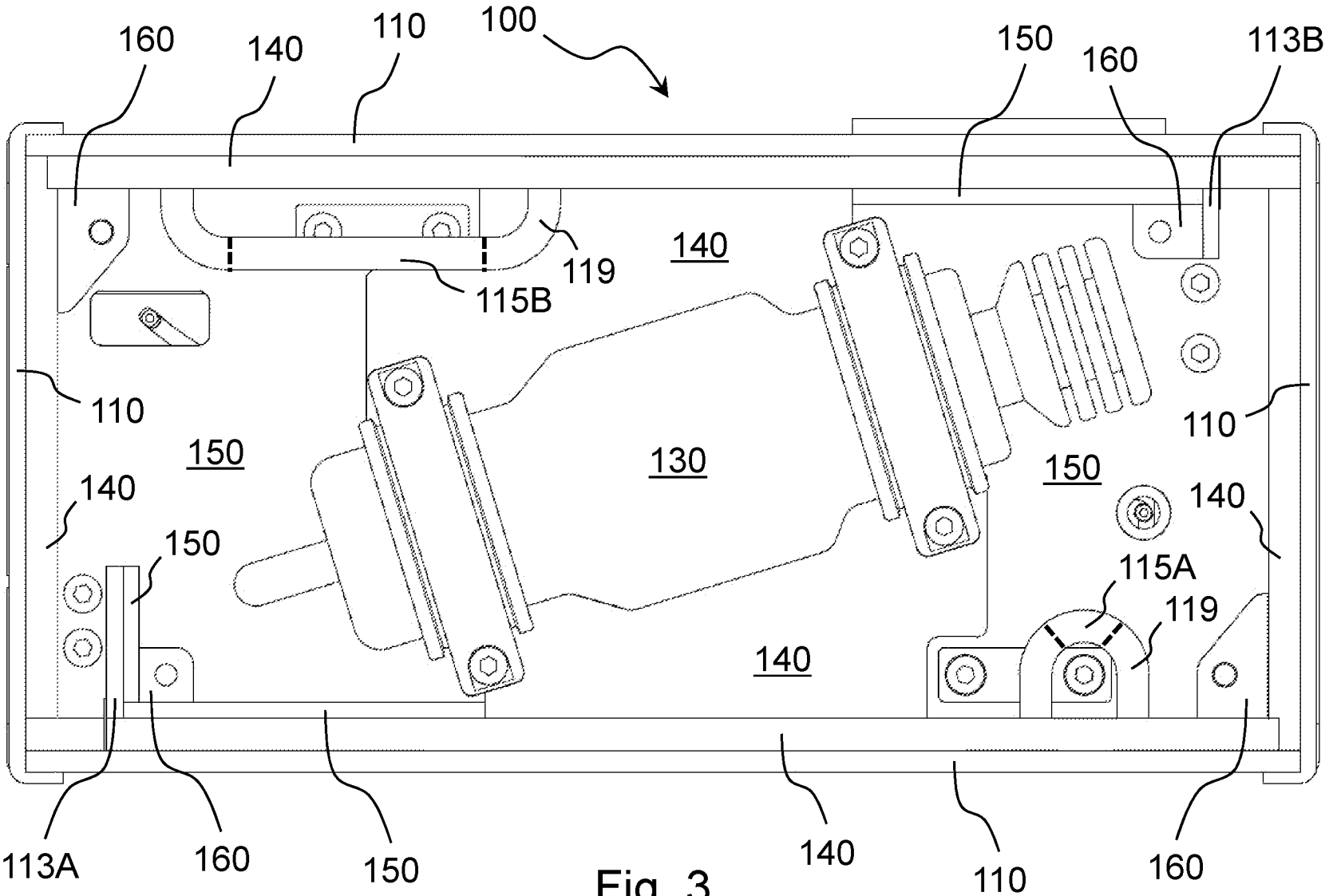

The present invention shall become more readily apparent from the detailed description that follows to be considered together with the accompanying drawings in which:

FIG. 1 shows a three-dimensional view of an embodiment of the X-ray emitting unit according to the present invention with a closed container, FIG. 2 shows a three-dimensional view of the unit of FIG. 1 with an open container, and FIG. 3 shows a two-dimensional view from above of the unit of FIG. 1 with an open container.

As can be easily understood, there are various ways of practically implementing the present invention which is defined in its main advantageous aspects in the appended claims and is not limited either to the following detailed description or to the appended claims.

DETAILED DESCRIPTION

The figures show an X-ray emitting unit 100 according to the present invention.

FIG. 1 also shows a generator 200 adapted to electrically supply the unit 100 and situated below the unit 100.

The 100 comprises a box-shaped container 110; in the example of the figures, the container 110 is comprised of a bottom (substantially flat, also known as "lower wall"), a cover (substantially flat, also known as "upper wall") and a body with sides (substantially flat), e.g. four sides (also known as "four side walls"); then there are plates (e.g. the plates 117A, 117B) which project from some of the container walls 110. The container 110 has a chamber 120 inside which an X-ray tube 130 is situated.

The container 110 is provided with an opening 111 for X-rays from which the X-rays emitted by the tube 130 exit, and a plurality of openings for cooling and electrically insulating liquid.

"Cooling" liquid means a liquid with physical properties such as to allow the removal of the heat produced by the tube 130 of the unit 100 through the aforesaid plurality of openings, described in more detail in the following description. "Electrically insulating" liquid means a liquid having dielectric properties such as to prevent the formation of electrical arc between the tube 130 and the container 110 in any use condition of the unit 100. In the example of the figures, the following openings are provided:

- a first main opening 112A designed for the inlet of cooling and electrically insulating liquid, but that could also be used for the outlet of the same liquid; the opening 112A is located on a first side of the container 110,
- a second main opening 112B designed for the outlet of cooling and electrically insulating liquid, but that could also be used for the inlet of the same liquid; the opening 112B is located on a second side of the container 110 opposite the first side,
- two secondary openings 114A and 114B of a first type for cooling and electrically insulating liquid which, for example, can be used indifferently for the inlet or outlet of the liquid; the openings 114A and 114B are situated respectively on the first side and on the second side of the container 110,
- two secondary openings 116A and 116B of a second type for cooling and electrically insulating liquid which, for example, can be used only for the outlet of the liquid; the openings 116A and 116B are situated on the cover of the container 110,
- a secondary opening 118 of the third type for cooling and electrically insulating liquid which, for example, can be used indifferently for the inlet or outlet of the liquid; the opening 118 is situated on the second side of the container 110.

Each opening for cooling and electrically insulating liquid of the container 110 (i.e. the openings 112A, 112B, 114A, 114B, 116A, 116B and 118) completely crosses a wall of the container itself for placing in fluid communication the chamber 120 with the external environment. The container 100 is adapted to be arranged in a sealed housing filled with cooling and electrically insulating liquid. The openings 112A, 112B, 114A, 114B, 116A, 116B and 118 allow the circulation of the cooling and electrically insulating liquid inside and outside the chamber 120 thanks to the motion of the fluid in the housing, in particular thanks to the natural convection motion thereof.

In the example of the figures, there is no opening for cooling and electrically insulating liquid on the bottom of the container 110 (but there are two openings for the passage of two electrical cables, respectively).

An opening for cooling and electrically insulating liquid of a second unit according to the present invention can be advantageously adapted to act as an inlet or outlet indifferently; however, it is not typically adapted to act as an inlet and outlet in different operating times of the unit.

The container 110, i.e. the bottom, the cover and the body thereof, is made of a shielding material that can advantageously be lead, a lead alloy or, more generally, a lead-based material; alternatively, the shielding material may be, for example, a tungsten-based radiation-absorbent plastic material, in particular containing at least 90% by weight of tungsten such as Gravi-Tech™ made by PolyOne.

The container 110 is in turn contained in a watertight casing preferably made of aluminium (not shown in the figures); the cooling and electrically insulating liquid circulates within the casing; in this way, the heat dissipation is optimal and any cooling fins can be integrated into the walls of the casing. The casing is advantageously made through an extrusion process.

The walls of the container 110 can be advantageously covered internally and externally by first layers 140 of a shielding material. The shielding material can advantageously be lead, a lead alloy or, more generally, a lead-based material; alternatively, the shielding material may be, for example, a tungsten-based radiation-absorbent plastic material, in particular containing at least 90% by weight of tungsten such as Gravi-Tech® made by PolyOne.

Advantageously, the walls of said container 110 are internally and selectively covered by second layers 150 of electrical insulating material. In fact, as time passes (days or weeks of operation of the unit), many electrostatic charges could accumulate on the tube (in particular at the end where the anode is located) and can lead to harmful electric discharge between the tube and the container. In the example of the figures, there is electrical insulating material not only on the side walls but also, on the bottom and/or the cover, in particular at the ends of the X-ray tube.

Such electric insulating material may be, for example, PEEK because not only does it have good electrical insulating properties, but is also resistant to X-rays. Advantageously, all or some of the screws of the box-shaped container may also be made of PEEK, in particular the clamping screws of the support elements of the X-ray tube.

All the openings for cooling and electrically insulating liquid of the container 110 (i.e. the openings 112A, 112B, 114A, 114B, 116A, 116B and 118) are slot-shaped, i.e. they are thin and long; this shape allows the passage of the liquid but tends to obstruct the passage of X-rays.

The first type secondary openings (see the openings 114A and 114B) have a plate (see plates 115A and 115B) of shielding material located frontally with respect to the opening itself inside the chamber. Shielding material means a radiation-absorbent material that can block the radiation emitted by the tube 130.

The second type secondary openings (see the openings 116A and 116B) have a plate (see plates 117A and 117B) of shielding material located frontally with respect to the opening itself outside the chamber.

Instead, the third type secondary openings (see the opening 118) have a very thin plate of shielding material or even have no plate of shielding material situated frontally with respect to the opening itself.

Such plates are provided with means that allow the flow of cooling and electrically insulating liquid through the openings, but prevent (more precisely they greatly reduce) radiation through the openings.

The third type secondary openings are adapted for the positions of the box-shaped container where it is useful to have a flow of cooling and electrically insulating liquid, but the radiation is null or small even without specific means.

Such plates are typically flat (such as, for example, plates 115B, 117A and 117B), but they may also be curved (such as for example the small plate 115A).

The plates 115A, 115B, 117A, 117B are positioned so as to block the openings 114A, 114B, 116A, 116B, in particular they are close to a wall of the container 110 and typically parallel to the wall itself; in this way, the unit does not radiate X-rays or almost and the cooling and electrically insulating liquid flows obstructed or with a small load loss.

Such plates are advantageously fixed to the container through connecting elements (see elements 119), for example arch shaped, in particular made of the same material.

Preferably, each plate is connected to two connecting elements 119 arranged in a mutually opposing position with respect to the plate itself, preferably so as to define a bridge-like configuration of the plate with respect to the respective opening.

Typically and advantageously, such plates and such connecting elements are made of a single part.

Preferably, the second type secondary openings are located in a position facing the X-ray tube 130, in particular its anode (which is the element that generates most heat), at a relatively reduced distance therefrom.

In more detail, the second type secondary openings are located at a shorter distance from the X-ray tube than the dimension of the respective plate 117A and 117B and the respective connecting elements 119, measured perpendicularly to the surface of the box-shaped container 110 on which the openings are obtained.

The proximity between the second type secondary openings and the X-ray tube is permitted by the arrangement of the respective plate outside the box-shaped container 110 and substantially improves the removal of heat by means of the cooling and electrically insulating liquid. The possibility to choose and use three different types of secondary openings for cooling and electrically insulating liquid makes it possible to freely design the inside of the chamber of the box-shaped container of the unit and the arrangement of the unit components contained in the chamber.

At the first main opening 112A and the second main opening 112B, the container 110 has at least one plate 113A and 113B (in particular flat) of shielding material arranged so as to guide (in the sense that the flow direction and the surface of the wall are parallel) the flow of cooling and electrically insulating liquid towards the inside and/or towards the outside of the chamber 120.

In particular, the plates 113A and 113B extend from a wall of the container 110 into the chamber 120 in a perpendicular (or oblique) direction with respect to the wall itself.

In particular, the plates 113A and 113B are parallel to another wall of the container 110 and are close to the wall itself; in this way, the cooling and electrically insulating liquid is guided on one side by the plate and on the other side by the wall and therefore two plates are not needed.

Also the plates 113A and 113B can be internally and selectively covered by layers 150 of electrical insulating material.

The container 110 comprises internal structural parts consisting of columns 160 located at corners (in particular vertical corners) of the container. Such columns can be made of electrical insulating material with good mechanical properties and good X-ray resistance properties such as, for example, fibreglass.

In general, the box-shaped container of the unit according to the present invention comprises and/or is associated with parts made of lead and/or a lead alloy and/or polyether-ester-ketone and/or fiberglass (in particular epoxy resin reinforced with fibreglass) and/or tungsten-based plastic material.

An X-ray emitting unit according to the present invention such as, for example, the unit 100 of the figures, can be used in a radiological apparatus for industrial applications.

An X-ray emitting unit according to the present invention such as, for example, the unit 100 of the figures, can be used in a radiological apparatus for medical applications.

Such radiological apparatus, for industrial or medical applications, is a further object of the present invention and comprises, as well as the unit 100, a fluid tight housing (not illustrated).

The housing defines an internal volume adapted to contain the cooling and insulating liquid. The unit 100 from which X-rays are appropriately emitted and shielded is arranged in the internal volume of the housing so as to be able to be immersed in the cooling and electrically insulating liquid contained therein.

The plurality of openings 112A, 112B, 114A, 114B, 116A and 116B on the box-shaped container 110 of the unit 100 allow a circulation of the cooling and electrically insulating liquid into and out of the chamber 120. Advantageously, the conformation of the openings described above allows such circulation also in the absence of forced convection means directly connected to the unit 100. For example, such circulation can take place by natural convection or be promoted by devices acting on the internal volume of the housing itself such as, for example, pumps or fans, outside the chamber 120. Preferably, the radiological apparatus comprises means of heat extraction acting on the cooling and insulating liquid in the inner volume, outside the chamber 120, for extracting heat therefrom. In particular, such means of heat extraction comprise a heat exchanging surface facing a portion of the inner volume outside the chamber 120, e.g. a finned surface or heat exchanger.

The invention claimed is:

1. A radiological apparatus for industrial or medical applications comprising:

an X-ray emitting unit;

a sealed housing having an inner volume suitable for containing a cooling and electrically insulating liquid, said X-ray emitting unit being placed inside said inner volume in order to be sunk in the cooling and electrically insulating liquid;

wherein said X-ray emitting unit comprises a box-shaped container with a chamber inside and an X-ray tube placed in said chamber, wherein said box-shaped container is provided with an opening for X-rays and a plurality of openings for the cooling and electrically insulating liquid, the plurality of openings include a first main opening for the cooling and electrically insulating liquid, and a second main opening for the cooling and electrically insulating liquid;

wherein said plurality of openings further includes at least one first type of secondary opening for the cooling and electrically insulating liquid, said box-shaped container having at least one plate of shielding material located frontally with respect to the first type of secondary opening, inside said chamber; or at least one second type of secondary opening for the cooling and electrically insulating liquid, said box-shaped container having at least one plate of shielding material located frontally with respect to the second type of secondary opening, outside said chamber;

wherein each of the plurality of openings is configured for circulating the cooling and electrically insulating liquid into and out of each of said plurality of openings to allow circulation of the cooling and electrically insulating liquid inside and outside the chamber due to natural convection motion of the fluid in the sealed housing without the use of a pump.

2. The radiological apparatus according to claim 1, wherein the walls of said box-shaped container are made of shielding material or internally and entirely covered by first layers of shielding material.

3. The radiological apparatus according to claim 2, wherein the walls of said box-shaped container are internally and selectively covered by second layers of electrical insulating material.

4. The radiological apparatus according to claim 1, wherein said first main opening or said second main opening or said first type of secondary opening or said second type of said secondary opening is slot-shaped.

5. The radiological apparatus according to claim 1, wherein at said first main opening or at said second main opening said box-shaped container has at least one plate of shielding material arranged in such a way as to guide the flow of the cooling and electrically insulating liquid inwards or outwards of said chamber.

6. The radiological apparatus according to claim 1, wherein said at least one second type of secondary opening is located in a position facing said X-ray tube.

7. The radiological apparatus according to claim 6, wherein said at least one second type of secondary opening is located at a distance from said X-ray tube less than a dimension of the respective plate and of a related connecting element.

8. The radiological apparatus according to claim 1, wherein said box-shaped container comprises internal structural parts consisting of columns located at corners of said box-shaped container.

9. The radiological apparatus according to claim 1, wherein said box-like container comprises parts made of lead or a lead alloy or polyether-ester-ketone or fiberglass or tungsten-based plastic material.

10. The radiological apparatus according to claim 1, wherein at least one plate of shielding material is flat.

11. The radiological apparatus according to claim 10, wherein said at least one plate of shielding material is connected to said box-like container by two opposed connecting elements.

12. The radiological apparatus of claim 1, further comprising:

means for extracting heat acting on the cooling and electrically insulating liquid in the inner volume in order to extract heat from the cooling and electrically insulating liquid.

13. The radiological apparatus of claim 12, wherein said means for extracting heat comprise a heat exchanging surface facing a portion of the inner volume outside of said chamber.

* * * * *